US005879777A

United States Patent [19]

Shipley

[11] Patent Number: 5,879,777

[45] Date of Patent: Mar. 9, 1999

[54] MODULAR PAPERMAKING FABRIC

[75] Inventor: Gale Shipley, Mauldin, S.C.

[73] Assignee: Asten, Inc., Charleston, S.C.

[21] Appl. No.: 879,213

[22] Filed: Jun. 19, 1997

[51] Int. Cl.[6] ..... B32B 3/06

[52] U.S. Cl. ..... 428/100; 428/101; 428/190; 428/193

[58] Field of Search ..... 428/100, 101, 428/190, 193

[56] References Cited

U.S. PATENT DOCUMENTS

| | | | |
|---|---|---|---|
| 3,905,071 | 9/1975 | Brumlik | 24/204 |
| 3,943,981 | 3/1976 | De Brabander | 139/391 |
| 4,035,872 | 7/1977 | MacBean | 24/31 H |
| 4,271,222 | 2/1981 | Hahn | 428/193 |
| 4,311,172 | 1/1982 | Eckstein | 139/383 A |
| 4,439,273 | 3/1984 | Curry | 162/358 |
| 4,537,658 | 8/1985 | Albert | 162/348 |
| 4,842,905 | 6/1989 | Stech | 428/33 |
| 5,202,170 | 4/1993 | Hsu et al. | 428/48 |
| 5,268,076 | 12/1993 | Best et al. | 162/358.2 |
| 5,360,656 | 11/1994 | Rexfelt et al. | 428/193 |
| 5,419,017 | 5/1995 | Buchanan et al. | 24/33 R |

FOREIGN PATENT DOCUMENTS 0802280 10/1997 European Pat. Off. ..... 6/DIG. 21 F

OTHER PUBLICATIONS

Unknown Publication, Section 21710—Zipper Seam For Paper Machine Dryer Fabrics.

*Primary Examiner*—Marion McCamish
*Attorney, Agent, or Firm*—Volpe and Koenig, P.C.

[57] ABSTRACT

A papermaking fabric comprised of modular panels secured to one another by hook and loop tape fastener material or similar fastening means. The fabric can be repaired by removing therefrom a section encumbering the damage and securing in its place in overlapping relationship with the existing panels a replacement panel section which bonds to the existing fabric base by similar fastening type means. Alternatively, the fastening means may be used to join the ends of a fabric.

11 Claims, 6 Drawing Sheets

MODULAR PAPERMAKING FABRIC

BACKGROUND OF THE INVENTION

1. Field of the Invention

The present invention relates to papermaking fabrics. More particularly, it relates to utilizing hook and loop mesh fastener material to secure modular panels as a base fabric for a press felt or to seam a papermaking fabric.

2. Description of the Prior Art

Papermaking fabrics are used to form, transport, dewater and dry paper on a papermaking machine. Papermaking press felts are designed to transport an aqueous web of paper through the press rollers of a papermaking machine and to assist in the de-watering of the paper web. Commonly, a papermaking wet press felt is constructed from a woven base fabric having batt material needled to one or both sides.

The felts may be woven as endless felts, however, the use of a seam to join the ends of a flat felt into an endless felt is often desirable as it allows for ease of installation of the felt onto the papermaking machine. The seam may be of the pin type which utilizes a joining wire or pintle to secure opposing series of seaming loops projecting from the fabric's ends together. The insertion of a pintle is generally tedious and time consuming and can damage the seaming loops. Additionally, the high speed and conditions of operation often result in extreme conditions of wear at the seam. Many attempts to strengthen the seam have resulted in seams which are not uniform with the rest of the felt whereby undesirable markings and/or irregularities in the paper product result. As such, it is desirable to provide a seam which can be joined more efficiently while maintaining the characteristics and strength of the fabric.

During the papermaking process, papermaking fabrics are sometimes subjected to accidental perforation. A perforated fabric causes defects in the paper made therewith and must be replaced or repaired. A typical fabric may be 90 feet in length and 20 feet wide and cost upwards of $30,000 or more. Accordingly, the ability to provide a repairable fabric is desirable.

In the case of large tears or holes, a papermaking fabric cannot easily be repaired. In areas where longitudinal machine direction yarns are interrupted over a substantial width, a fabric forms a wave or ridge which has a detrimental effect on paper quality and safe operation. In cases of minor damage areas, i.e. having damage less than 20 millimeters, which tend to occur more a frequently, it is generally practical to continue using the papermaking fabric, at least for some time, on non-mark critical paper grades.

Prior art methods of fixing damaged fabrics include manual restitching over the damaged area using substitute yarns. However, this method is very time consuming and difficult to perform and can only be done by experienced and trained personnel. In addition, the mending method takes a long time and shut down costs of the machine are very high.

An alternate method for repairing damaged fabrics is patching with a woven patch. However, selecting a proper patch is difficult since the proper type of patch and adhesive must be chosen and the patch cannot be too thin or too thick so as to form an uneven paper surface. In addition, this method of repair cannot be used with press fabrics.

Another prior art attempt for patching damaged areas includes ultrasonic welding of a patch to the damaged area. However, this can be a problem with synthetic fibers, i.e. nylon and polyester, in that the heat from the weld can damage the materials. In addition, the welding requires skilled and trained personnel to perform the operation and furthermore, cannot be utilized with press fabrics.

Thus it is desirable to provide a laminated multi-layer base fabric for a press felt which combines the ease of installation of a flat woven fabric while maintaining the fabric characteristics of an endless woven fabric.

SUMMARY OF THE INVENTION

A modular papermaking press base fabric comprises first and second layers of synthetic mesh construction which are joined together by complementary hook and loop fastener material or similar fastening means. Preferably, each layer is comprised of a plurality of panels mutually fastened to each other. The top layer panels being maintained in position by bottom layer panels fastened to multiple top layer panels and vice versa. In an alternate embodiment, the fastening means is utilized to join the ends of the panels.

It is the object of the invention to provide a modular construction for a papermaking fabric which enhances installation of cumbersome fabrics i.e. wide, long, and heavy and aids mending damaged areas.

DESCRIPTION OF THE PREFERRED EMBODIMENT

Figure 1:
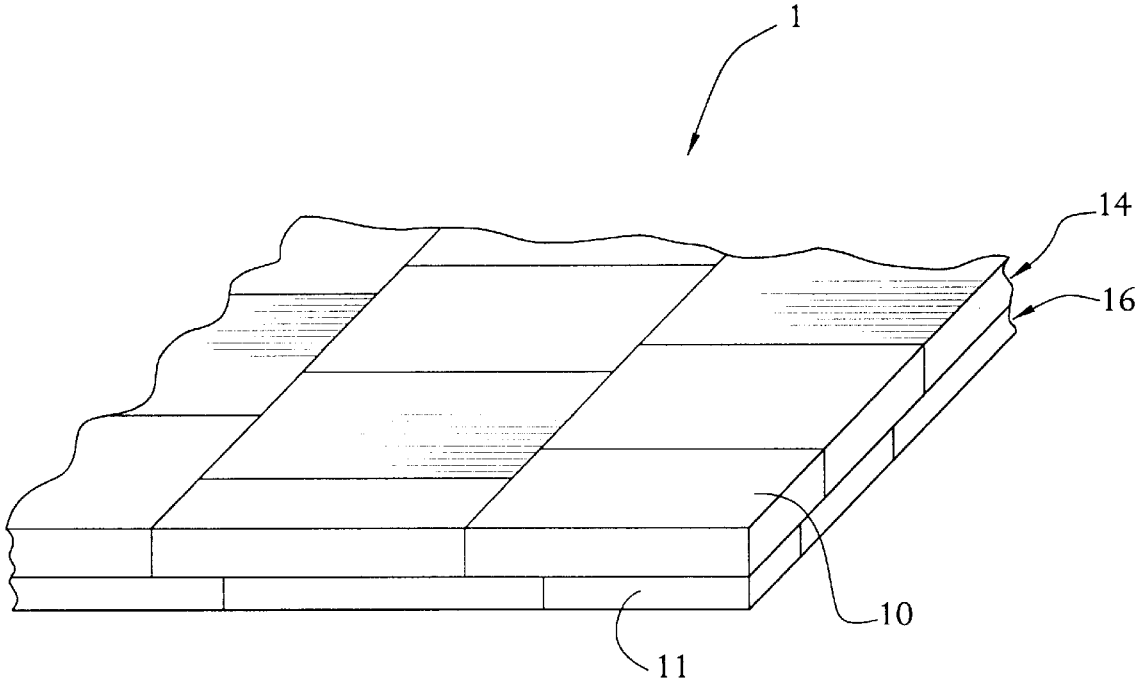
FIG. 1 is a perspective view of a preferred embodiment of a papermaking fabric made in accordance with the teachings of the present invention.

The preferred embodiment will be described with reference to the drawing figures where like numerals represent like elements throughout.

A modular papermaking press base fabric 1 made in accordance with the teachings of the present invention is shown in FIG. 1. The modular base fabric 1 is comprised of modular panels 10, 11 which form a first layer 14 and second fabric layer 16. In the preferred embodiment, the modular panels 10, 11 are non-woven, nylon rectangular panels. However, panels may consist of PET, polyethylene, acrylics, or any other thermoplastic polymer or copolymer. The fastener may not only be constructed of the above material, but metals as well. Fastening embodiments may be course or extremely dense, in a hook/loop configuration, ball/socket configuration, or other complementary fastening configuration. The panels 10, 11 preferably have a length of approximately 25 feet and a width of approximately 10 feet.

Figure 2:
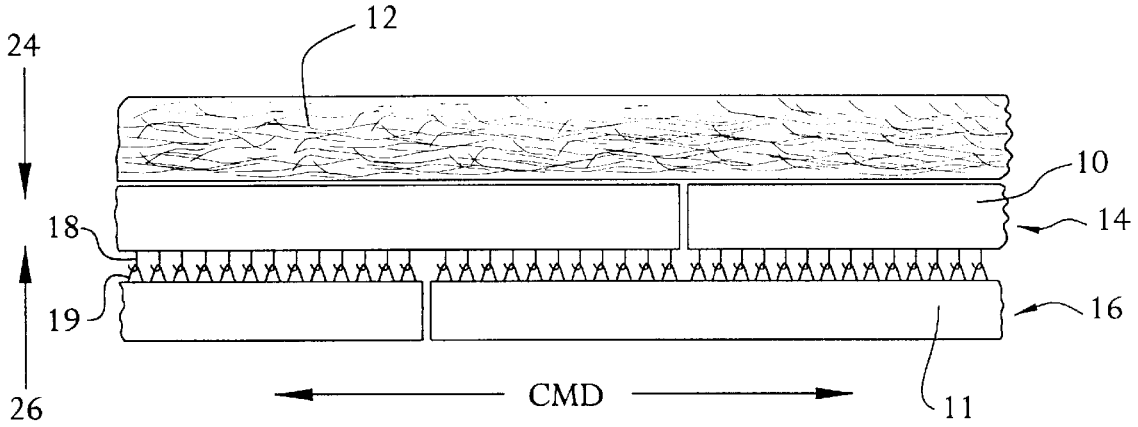
FIG. 2 is a section view showing the cross machine direction of the modular fabric made in accordance with the teachings of the present invention.
Figure 3:
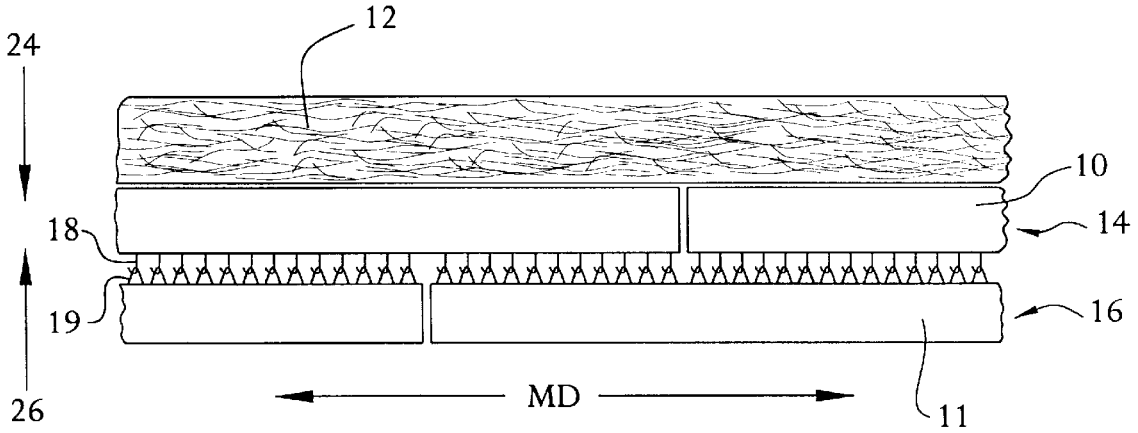
FIG. 3 is a section view showing the machine direction of the modular fabric made in accordance with the teachings of the present invention.

As shown in FIGS. 1–3, the modular panels 10 of the first layer 14 are secured to modular panels 11 of the second layer 16 such that the first layer 14 seams are staggered from the second layer 16 seams in both the machine direction and cross machine direction. The seams preferably overlap by approximately 7 to 15 inches. This overlapping secures the base fabric 1 as a unitary whole.

As more clearly shown in FIGS. 2 and 3, the panels of the respective base fabric layers 14 and 16 are secured to one another by a plurality of complementary fasteners. In this respect, it is preferred to use complementary fasteners of the types sold under the trademark "Velcro" by Velcro Corporation. However, it would be obvious to those skilled in the art to use any one of a number of complementary type fasteners, for example, extending sockets and complementary extending balls.

The illustrated Velcro® fastening material consists of cooperating sheets of adhesive material with one of the materials having tiny plastic hooks 18 extending therefrom and the other material having tiny plastic loops 19 extending therefrom. When pressed together, the hooks 18 engage the loops 19 and retain the two materials together. The hooks 18 and loops 19 can be disengaged from each other upon the application of a sufficient separating force.

In construction of the base fabric 1, the fabric layers 14 and 16 are placed together in the direction as shown by arrows 24 and 26. On one surface of the panel, there is provided a series of hooks 18 which complement the respective loops 19 on one surface of the corresponding panels. Each loop 19 is dimensioned to receive a hook 18 and each hook 18 is dimensioned to be received within each loop 19. In this manner, the longitudinal edges of the panels 14, 16 are placed adjacent to each other and form a paper carrying surface. Interconnection of the hooks 18 and loops 19 may be made by either snap fit, by rotating the edges one to the other or by meshing the elements end to end. If the particular paper making process requires such, a batting 12 may be needled, stitched or laminated to one or both layers of the base fabric 1, either before or after installation of the fabric. The batting 12 may be individual fibers or a woven base structure.

Figure 4:
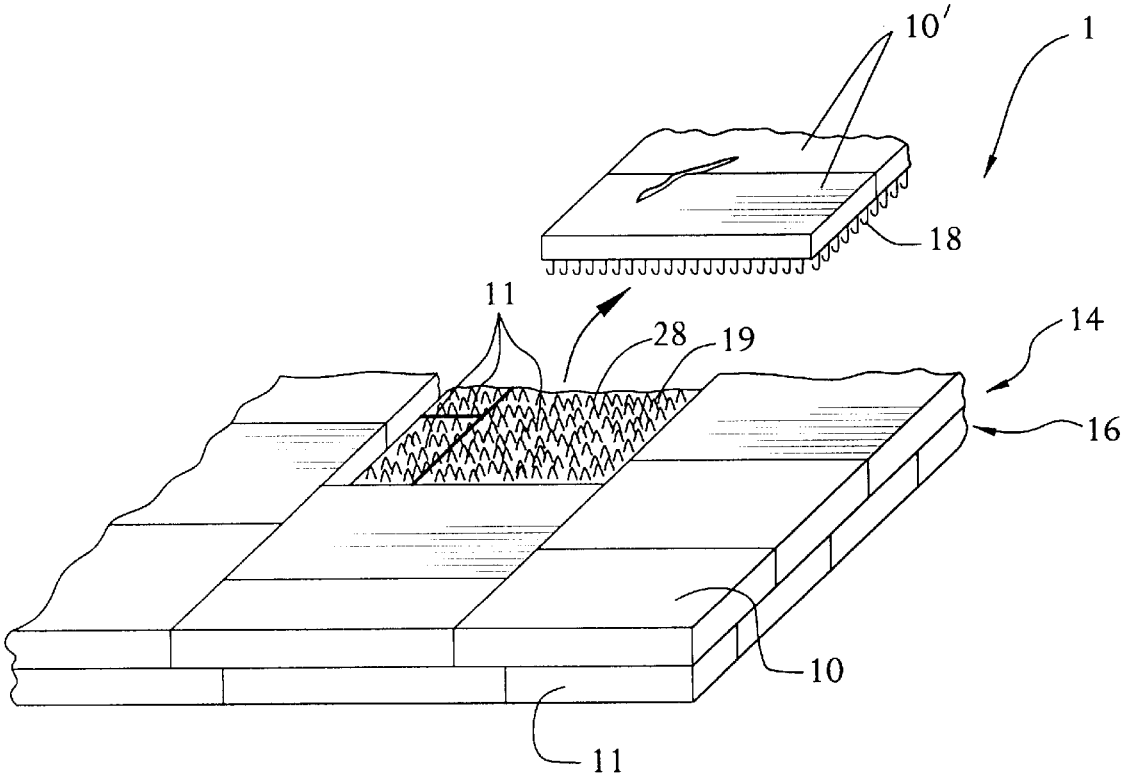
FIG. 4 is a perspective view of the modular fabric with a damaged section removed from the base fabric.
Figure 5:
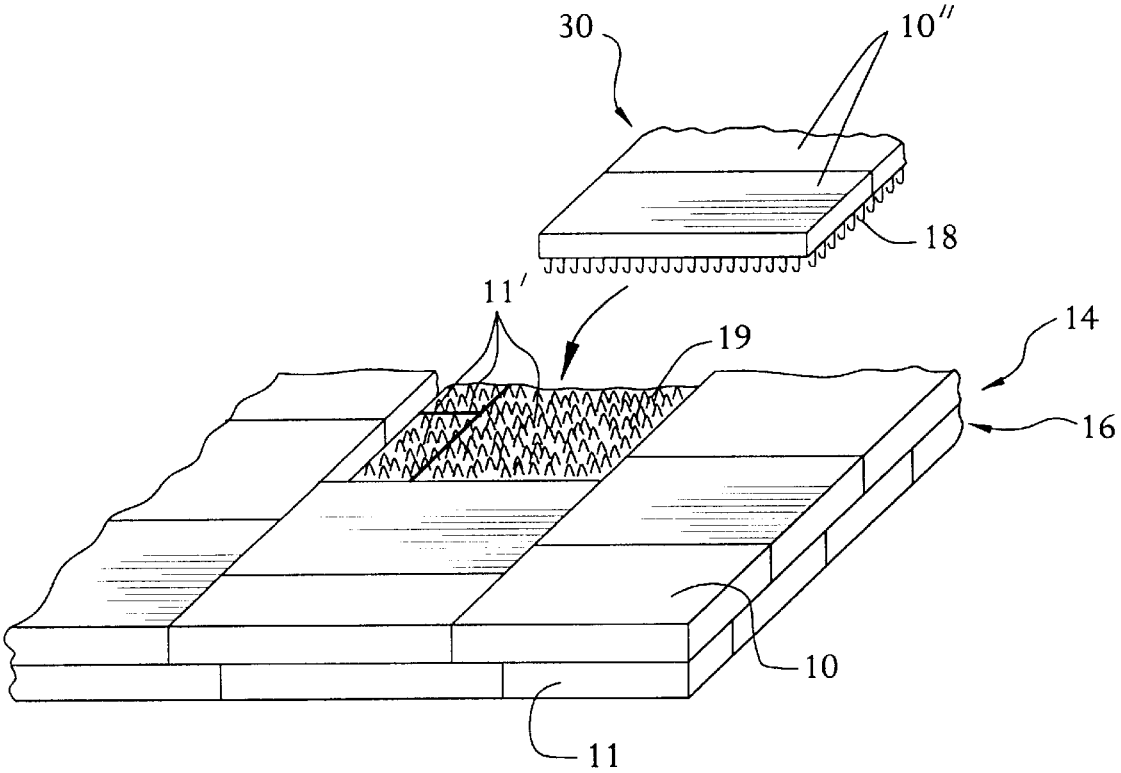
FIG. 5 is a perspective view of a modular patch section being placed into the area cleared by removal of the damaged section.

FIGS. 4 and 5 show the replacement of a damaged section of the base fabric 1. In a first step as shown in FIG. 4, one or more damaged panels 10' are removed from the base fabric 1 which leaves an open area 28. The damaged panel(s) 10' is removed by separating the hooks 18 of the panel(s) 10' from the loops 19 of the corresponding panel(s) 11. The areas of overlap can be more clearly seen when the damaged panel(s) 10' is removed.

As shown in FIG. 5, a replacement modular section 30 is positioned for placement into the open area 28 vacated by the removed damaged panel(s) 10'. The replacement modular section 30 consists of an equal number of equivalent panel(s) 10" so that it encompasses the open area 28 without extending over and beyond the periphery of the entire fabric structure.

The panel(s) 10" of the replacement modular section 30 has a plurality of hook fasteners 18 disposed on one side. The hook fasteners 18 are positioned for engagement with the complimentary loops 19 of the panel(s) 11' of the second layer 16 which were exposed when the damaged panel(s) 10' was removed. Since the replacement modular section 30 consists of modular panels 10" which are essentially identical to the original panels 10, it does not project above nor below the surface of the existing base fabric. Batting 12 is preferably needled, stitched or laminated to the replacement modular section 30 prior to installation, such that the papermaking fabric is restored to a homogenous fabric.

In the preferred embodiment, the base fabric 1 has a caliper of approximately 0.040" to 0.075". The finished fabric preferably has a caliper between 0.090" to 0.140" and a permeability in the range of 10–70 CFM.

It will be recognized by those skilled in the art that the fabric panels as described herein may be arranged in a variety of geometric configurations. It is possible that one or both layers 14, 16 is comprised of a single panel. Likewise, the complementary geometric configurations do not necessarily have to run in the direction of the paper carrying surface. However, for ease of construction, it is preferred to maintain simple geometric configurations to assure fabric integrity.

Figure 6:
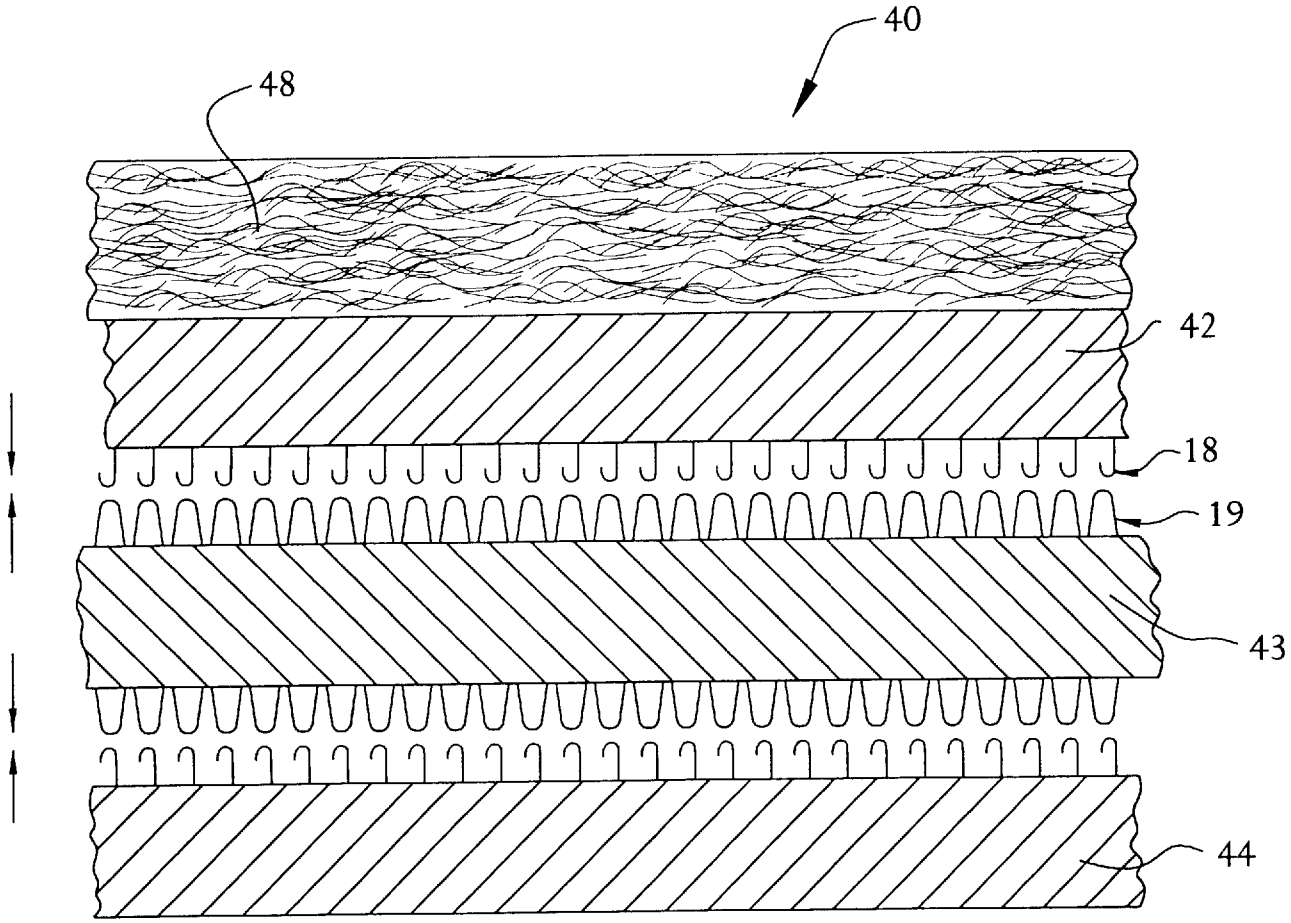
FIG. 6 is a section view of an alternate embodiment of the present invention.

An alternative embodiment of the present invention is shown in FIG. 6. In this embodiment, the base fabric 40 is composed of three layers 42, 43 and 44 interconnected by complementary hook 18 and loop 19 fasteners. The intermediate layer 43 has loop fasteners 19 disposed on both surfaces thereof for engagement with complimentary hook fasteners 18 on one side of the first layer 42 and hook fasteners 18 on one side of the third layer 44. After connection of the three base layers 42, 43 and 44, a batting material 48 can be needled, stitched, or laminated to one or both surfaces of the base fabric 40.

Figure 7:
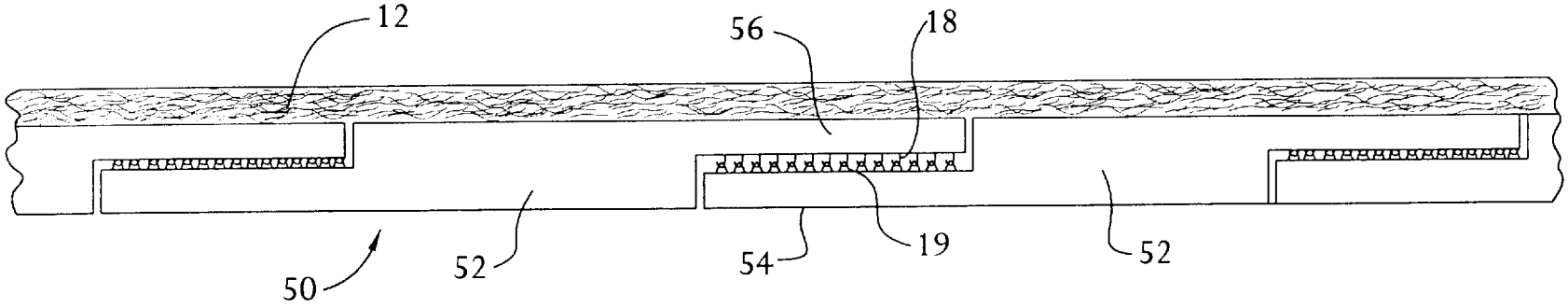
FIG. 7 is an elevational view of a further alternative embodiment.

FIG. 7 shows another alternative embodiment of the present invention. In this embodiment, the base fabric 50 is constructed from one or more panels 52 which have flaps 54, 56 on each end. Each flap 54 complements the next adjacent flap 56. For each panel 52, one of the flaps has hooks 18 on its inner surface, while the other flap has complementary loops 19 on its inner surface. Preferably each flap is at least 10 inches in length. The panels 52 can be joined by interconnecting the hook 18 and loop 19 fasteners to construct a base fabric 50 of any desired length. The base fabric may be assembled on a papermaking machine by overlapping the last two flaps 54, 56 of the fabric 50 rather than by tediously inserting a pintle, as in standard seam products. The chances of loop damage or misloops is eliminated and the seam strength is as high as or higher than standard woven loop products. This configuration also allows damaged panels to be easily replaced. The base fabric 50 may however, consist of only one long panel 52, with its own flaps 54, 56 joined. Batting 12 may be needled, stitched or laminated to one or both sides of the fabric 50, as desired.

It would be apparent from the description of the invention hereinabove that one of the unique features of this invention is in the modular type of structure of the press felt that is obtained by the layering of specific modular panel units. Any of the modular panels that consist of a batt and web or yarn array can be constructed of certain specified materials which would give predetermined physical properties to the felt which otherwise could not be obtained. An advantage is that the use of separate modular base assemblies imparts to the felt exceptional dimensional stability which is required in papermakers felts, especially with those that include nonwoven fabrics. Alternatively, the batt fibers in a yarn assembly or in any module can be oriented in a cross machine direction.

From the above, it can be seen that the present invention provides the papermaking fabric designer and repairer with flexibility which has been unknown heretofore in the art. Since the elements may be molded or constructed from other than filament type materials, the designers are no longer limited to those materials which may produce yarn like structures. Accordingly, the papermaking fabric designer may select any material which can be worked into the required shape. Plus the fabric designer may take advantage of the characteristics of several materials within a single fabric. In addition to the material advantages, the designers also are provided with a means for modifying properties and characteristics to meet the different working environments which exist across the width of the paper machine. This permits the papermaking fabric designer to more fully accommodate the characteristics and environment that exist in the papermaking equipment. The ability to produce the fabrics from non-woven materials also reduces the manufacturing time.

The use of modular panels allows the length and width of the fabric to be easily varied to accommodate various position sizes. The modular panels also allow the fabric to be repaired by section, as discussed above. The complementary type fasteners promote these advantages and also allow the fabric to be installed as an open fabric.

While the present invention has been described in terms of the preferred embodiment, other variations which are within the scope of the invention as outlined in the claims will be apparent to those skilled in the art.

I claim:

1. A modular papermaking fabric comprising:

a plurality of synthetic mesh panels which form a first fabric layer;

a plurality of synthetic mesh panels which form a second fabric layer; and said first and second fabric layers joined together by fastening means disposed on said synthetic mesh panels such that said first layer panels are held in position in said first layer by second layer panels which are fastened to multiple first layer panels and said second layer panels are held in position in said second layer by first layer panels which are fastened to multiple second layer panels.

2. The fabric of claim 1 wherein the fastening means includes complementary hooks and loops.

3. The fabric of claim 1 wherein the fastening means includes complementary balls and sockets.

4. The fabric of claim 1 wherein each of said panels is individually removable.

5. The fabric of claim 1 wherein batt material is attached to said fabric.

6. A papermaking fabric comprising:

a first layer of a predetermined size, having first and second ends, including at least one synthetic panel;

a second layer of said predetermined size, having first and second ends, including at least one synthetic panel; and complementary type fastening means between said layers for connecting said first and second layers whereby the ends of the first layer are offset from the ends of the second layer such that the fabric can be joined on a papermaking machine.

7. The fabric of claim 6 wherein the fastening means includes complementary hooks and loops.

8. The fabric of claim 6 wherein the fastening means includes complementary balls and sockets.

9. The fabric of claim 6 wherein each of said panels is individually removable.

10. The fabric of claim 6 wherein batt material is attached to said fabric.

11. The papermaking fabric of claim 1 wherein the panels extend in the machine direction (MD) and the cross-machine direction (CMD) and said second layer panels are fastened to multiple first layer panels in both the MD and CMD and said first layer panels are fastened to multiple second layer panels in both the MD and CMD.

* * * * *